US010190738B1

(12) United States Patent
James et al.

(10) Patent No.: US 10,190,738 B1
(45) Date of Patent: Jan. 29, 2019

(54) LUMINAIRES AND LIGHT SOURCE RETENTION COMPONENTS

(71) Applicant: Inter-Lux, Inc., Baltimore, MD (US)

(72) Inventors: Douglas James, Baltimore, MD (US); Mark DeVries, Baltimore, MD (US)

(73) Assignee: Inter-Lux, Inc., Baltimore, MD (US)

( * ) Notice: Subject to any disclaimer, the term of this patent is extended or adjusted under 35 U.S.C. 154(b) by 0 days.

(21) Appl. No.: 15/717,168

(22) Filed: Sep. 27, 2017

(51) Int. Cl.

| | |
|---|---|
| ***F21S 4/00*** | (2016.01) |
| ***F21V 21/00*** | (2006.01) |
| ***F21S 8/02*** | (2006.01) |
| ***F21V 17/10*** | (2006.01) |
| ***F21V 19/00*** | (2006.01) |
| *F21V 29/70* | (2015.01) |
| *F21Y 115/10* | (2016.01) |
| *F21V 3/00* | (2015.01) |

(52) U.S. Cl.
CPC ..... *F21S 8/026* (2013.01); *F21V 17/107* (2013.01); *F21V 19/003* (2013.01); *F21V 19/0015* (2013.01); *F21V 3/00* (2013.01); *F21V 29/70* (2015.01); *F21Y 2115/10* (2016.08)

(58) Field of Classification Search
CPC ..... F21S 4/00; F21S 4/20; F21S 4/28; F21S 8/026; F21V 3/00; F21V 17/00; F21V 17/04; F21V 17/06; F21V 17/10; F21V 17/104; F21V 17/107; F21V 17/16; F21V 17/164; F21V 17/18; F21V 19/00; F21V 19/001; F21V 19/0015; F21V 19/002; F21V 19/003; F21V 19/0035; F21V 19/004; F21Y 2115/10
USPC ..... 362/249.02–249.06, 311.02, 433–446, 362/457–458, 800
See application file for complete search history.

(56) References Cited

U.S. PATENT DOCUMENTS

| | | | |
|---|---|---|---|
| 7,645,052 | B2 | 1/2010 | Villard |
| 8,177,385 | B2 | 5/2012 | Porciatti |
| 8,206,001 | B2 | 6/2012 | Piepgras et al. |
| 8,459,824 | B1 | 6/2013 | Esmailzadeh et al. |
| 8,485,700 | B2 | 7/2013 | Ngai |
| 2004/0213003 | A1 | 10/2004 | Lauderdale et al. |
| 2008/0266843 | A1 | 10/2008 | Villard |
| 2013/0039066 | A1 | 2/2013 | Porciatti |
| 2013/0308303 | A1 | 11/2013 | Greenholt et al. |
| 2014/0226316 | A1 | 8/2014 | Medendorp, Jr. et al. |
| 2016/0076746 | A1 | 3/2016 | Porciatti |

FOREIGN PATENT DOCUMENTS

| | | |
|---|---|---|
| WO | 2011112261 | 9/2011 |
| WO | 2015172075 | 11/2015 |
| WO | 2016008029 | 1/2016 |

OTHER PUBLICATIONS

Canadian Office Action for Application No. 2,983,870, dated Aug. 9, 2018, 4 pages.

*Primary Examiner* — Jason M Han
(74) *Attorney, Agent, or Firm* — Seyfarth Shaw LLP

(57) ABSTRACT

A luminaire and retaining device that retains LEDs in a housing of the luminaire through the use of a mechanical interface with the housing. The retaining device has a shape that engages the housing through a ratcheting feature, and allows the LEDs and retaining device to be removably installed in such a way that manufacturing time is reduced. This provides for easy of replacement or servicing of the LEDs.

20 Claims, 16 Drawing Sheets

LUMINAIRES AND LIGHT SOURCE RETENTION COMPONENTS

FIELD

The present invention relates generally to lighting. More particularly, the present invention relates to improved lighting and light source retention components.

BACKGROUND

Luminaires and other lighting devices are well-known and used in commercial and residential buildings. For example, light fixtures, track lights, and other types of light fixtures are installed in ceilings and walls. However, certain light fixtures can be bulky and have displeasing aesthetic appearances.

With the emergence of Light Emitting Diode (LED) type lights, light fixtures can be made smaller. However, when an LED malfunctions or fails in a LED type light fixture, it can be difficult to replace or service the LED.

SUMMARY

The present invention relates to recess mounted luminaires having a housing that provides a structural replacement for a drop ceiling tee bar main beam or cross beam. The luminaires may include at least one Light Emitting Diode (LED) mounted on a substrate or assortment of interlinked substrates, or at least one Organic Light Emitting Diode (OLED) device as a light source.

The present invention also relates to a retaining device that retains LEDs in the luminaire housing through the use of a mechanical interface with the housing. In one embodiment, the retaining device has a shape that engages the housing through a ratcheting feature, and allows the LEDs and retaining device to be removably installed in such a way that manufacturing time is reduced. This provides for easy of replacement or servicing of the LEDs.

An embodiment of the present invention broadly comprises a luminaire including a housing having a receiving area with an internal surface, and first and second opposing teeth disposed on the internal surface and extending towards each other into the receiving area. A light board is disposed in the receiving area, and a retention component is disposed in the receiving area and holds the light board in the receiving area. The retention component has opposing first and second retention arms with respective ratcheting teeth adapted to engage the first and second opposing teeth to hold the light board in the housing.

Another embodiment of the present invention broadly comprises a retention component adapted to retain a light board in luminaire housing. The retention component includes a base portion having opposing first and second ends, first and second hinges respectively coupled to the opposing first and second ends, first and second retention arms respectively coupled to the first and second hinges, and first and second teeth respectively disposed on the first and second retention arms. The first and second teeth are adapted to engage the luminaire housing and retain the light board in the luminaire housing.

Another embodiment of the present invention broadly comprises a luminaire having a light emitting element. The luminaire includes a housing having a receiving area with an internal surface. First and second opposing teeth are disposed on the internal surface and extending towards each other into the receiving area. A retention component is disposed in the receiving area. The retention component includes a base portion having opposing first and second ends, first and second hinges respectively coupled to the opposing first and second ends, first and second retention arms respectively coupled to the first and second hinges, and first and second ratchet teeth respectively disposed on the first and second retention arms. The first and second ratchet teeth are respectively adapted to engage the first and second opposing teeth and retain the light emitting element in the luminaire.

BRIEF DESCRIPTION OF THE DRAWINGS

For the purpose of facilitating an understanding of the invention, there are illustrated in the accompanying drawings embodiments thereof, from an inspection of which, when considered in connection with the following description, the invention, its construction and operation, and many of its advantages should be readily understood and appreciated.

DETAILED DESCRIPTION

Figure 1:
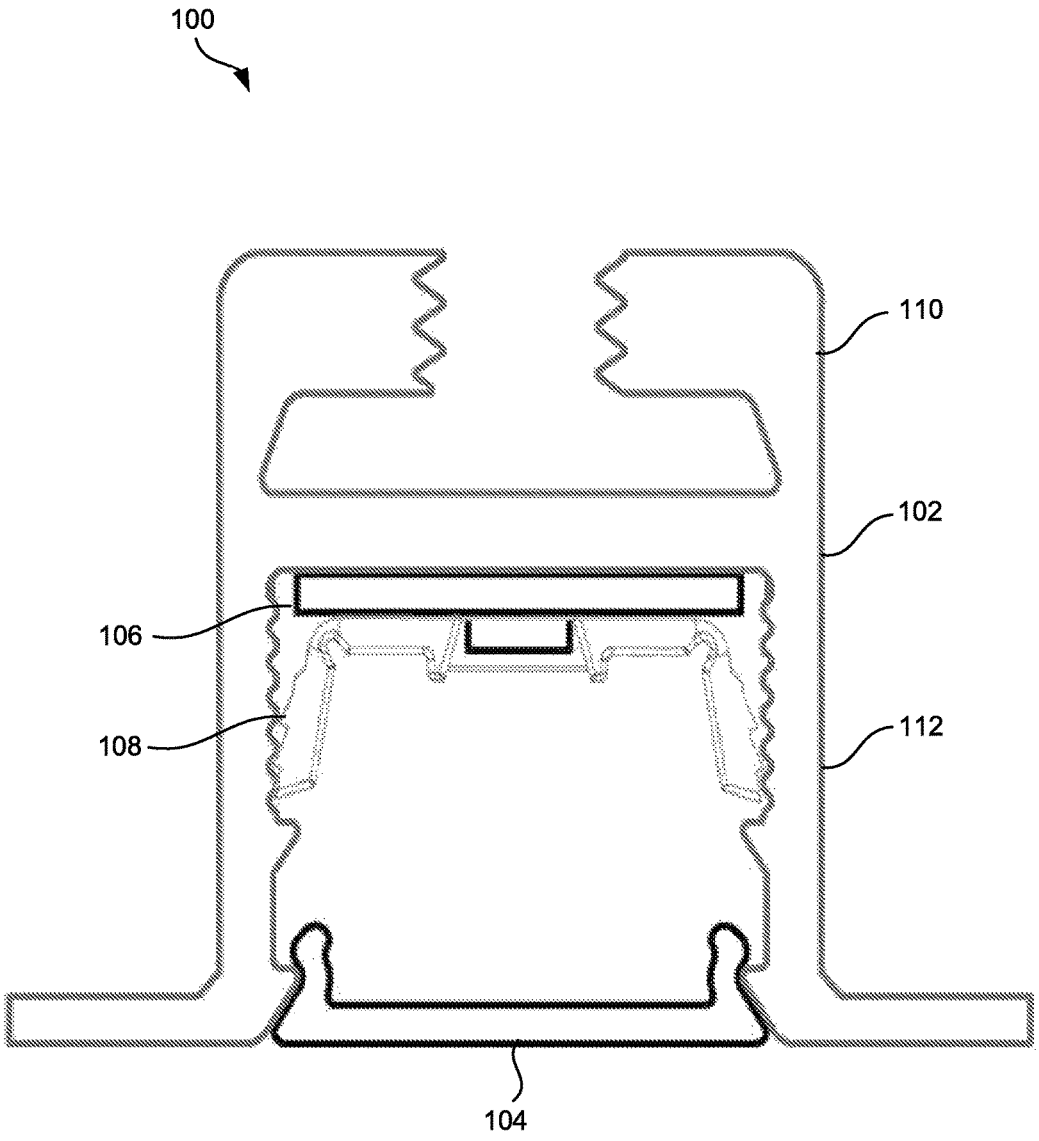
FIG. 1 is a side view of a luminaire according to an embodiment of the present invention.

While the present invention is susceptible of embodiments in many different forms, there is shown in the drawings, and will herein be described in detail, embodiments of the invention, including a preferred embodiment, with the understanding that the present disclosure is to be considered as an exemplification of the principles of the invention and is not intended to limit the broad aspect of the invention to embodiments illustrated. As used herein, the term "present invention" is not intended to limit the scope of the claimed invention and is instead a term used to discuss exemplary embodiments of the invention for explanatory purposes only.

Embodiments of the present invention broadly comprise recess mounted luminaires having a housing that provides a structural replacement for a drop ceiling tee bar main beam or cross beam. The luminaires may include at least one Light Emitting Diode (LED) mounted on a substrate or assortment of interlinked substrates, or at least one Organic Light Emitting Diode (OLED) device as a light source.

Embodiments of the present invention also comprise a retaining device that retains LEDs in the luminaire housing through the use of a mechanical interface with the housing. In one embodiment, the retaining device has a shape that engages the housing through a ratcheting feature, and allows the LEDs and retaining device to be removably installed in such a way that manufacturing time is reduced. This provides for easy of replacement or servicing of the LEDs.

Figure 2:
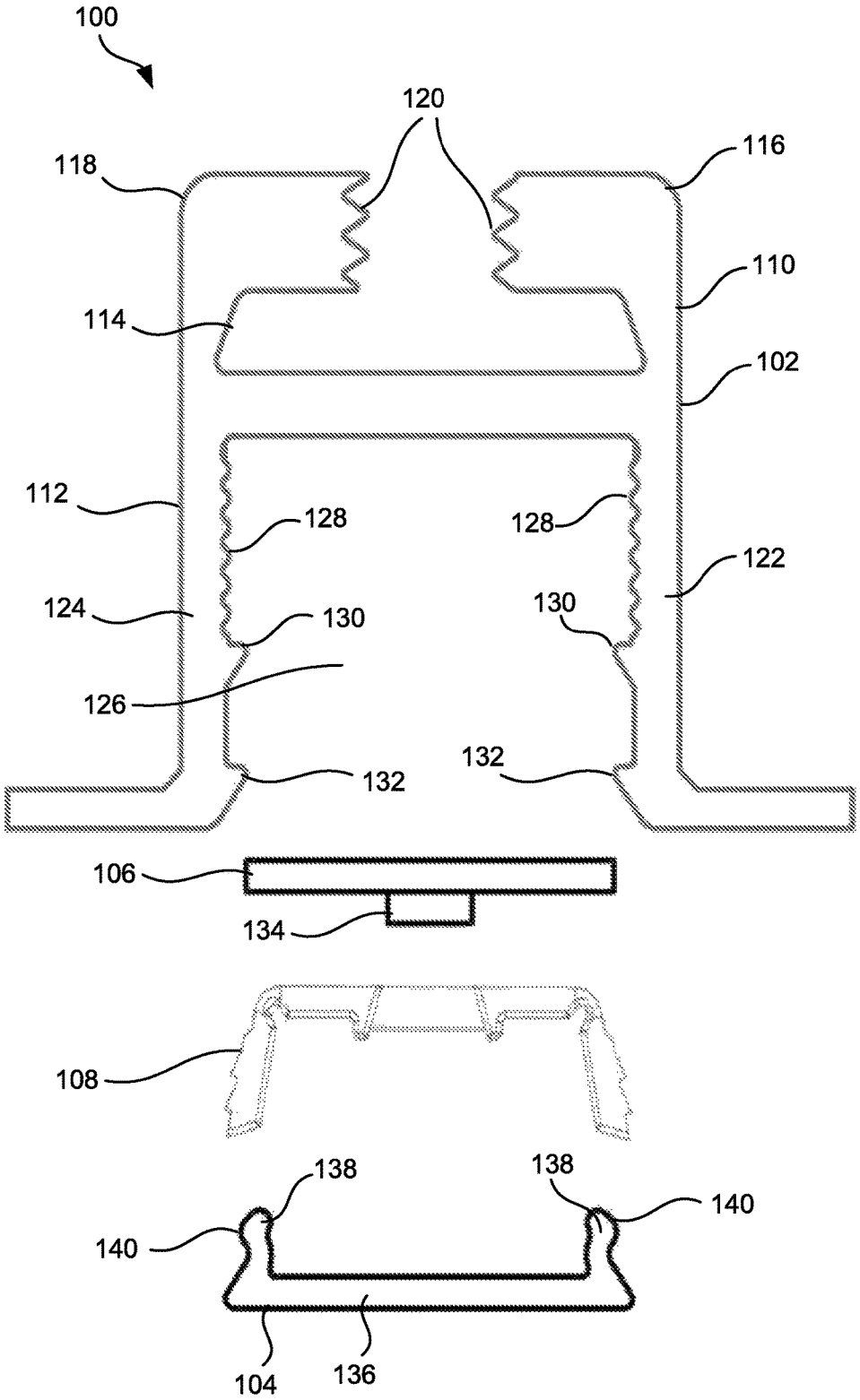
FIG. 2 is an exploded view of the luminaire of FIG. 1.

Referring to FIGS. 1 and 2, a luminaire 100 includes a structural body 102 (also referred to as a housing 102), a diffuser 104 or lens, a light board 106 (including one or more Light Emitting Diodes (LEDs), for example), and a retention component 108. In one embodiment, the retention component 108 couples to the housing 102 and retains the light board 106 in the housing 102.

The housing 102 includes an upper portion 110 and a lower portion 112. The upper portion 110 includes a channel or track 114 adapted to couple to a T-bar type hanger for a suspended ceiling. However, the channel or track 114 may be sized and shaped to couple to other type of hangers for suspended ceilings. As illustrated, the channel or track 114 is formed by opposing first and second arms 116 and 118, respectively, that extend upwardly (away from the lower portion 112) and inwardly towards one another to form the channel or track 114 having an inverted "T" shape. Ends of the first and second arms 116 and 118 facing one another may also include teeth or threads 120 that engage the T-bar type hanger for the suspended ceiling.

The lower portion 112 includes opposing first and second support arms 122 and 124, respectively, that extend downwardly (away from the upper portion 110) and outwardly away from one another forming a receiving area 126 between the first and second support arms 122 and 124, respectively. Portions of the first and second support arms 122 and 124, respectively, which extend outwardly away from one another provide a supporting structure that is adapted to hold a ceiling tile, such as a ceiling tile of a suspended ceiling.

As illustrated, the receiving area 126 has an internal surface having opposing teeth 128 and opposing first protrusions 130 proximate to the teeth 128, which are used in conjunction with the retention component 108, as described in further detail below. As illustrated, the teeth 128 extend from the respective support arms 122, 124 towards one another into the receiving area 126. The internal surface of the receiving area 126 may also include second protrusions 132 that extend towards one another and that are spaced from the first protrusions 130 and proximate an opening of the receiving area 126, which are used in conjunction with the diffuser 104, as described in further detail below.

Figure 3:
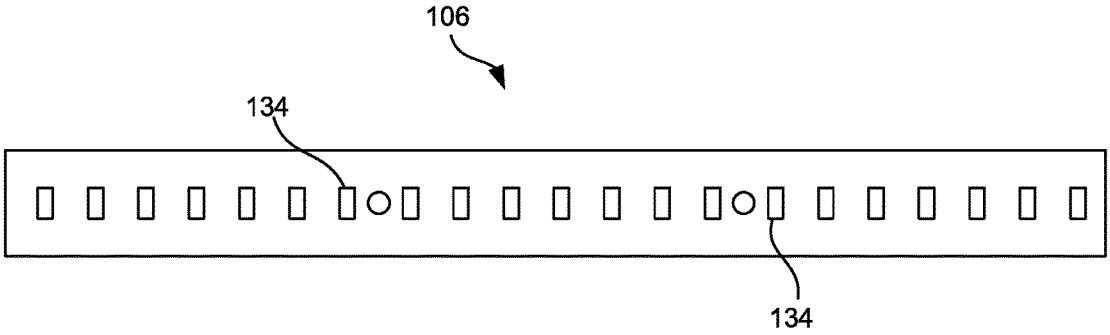
FIG. 3 is a plan view of a light board and light source of the luminaire of FIG. 1.

Referring to FIGS. 2 and 3, the light board 106 may include one or more lighting elements 134, such as LEDs or OLEDs, coupled thereto. The light board 106 may be a single light board 106 or an assortment of interlinked light boards 106. For example, the light board 106 may be separable, for example, at about 25 mm increments, to allow for adjustment and customization of the amount of light desired.

As illustrated in FIG. 1, the light board 106 is disposed in the receiving area 126 of the housing 102 proximate to a top of the lower portion 112 of the housing 102. In one embodiment, the housing 102 may an extruded aluminum housing, and the combination of the light board 106 and housing 102 serve as a heat sink for heat dissipation. Power may be supplied to the housing 102 by means of a quick disconnect mounted to or integral to the luminaire. In another embodiment, an electrical connection to the light board 106 is provided by means of a multi-pole electrical trace bonded within the housing 102 with a mating electrical spring connection to the light board 106 where no additional soldering is required during assembly.

Referring to FIG. 2, the diffuser 104 may include a main body 136 and opposing arms 138 extending from the main body 136. The opposing arms 138 may also include protrusions 140 that extend outward. These protrusions 140 are flexible and allow for the diffuser 104 to be coupled to the support arms 122 and 124, respectively, by engaging the second protrusions 132. This allows the diffuser to be snap-fit into the housing 102 and close the receiving area 126. The diffuser 104 may be any type of lens adapted for the dissipation of light, and may be ground glass, Teflon, holographic, opal glass, greyed glass, or other acceptable material, for example.

Figure 8:
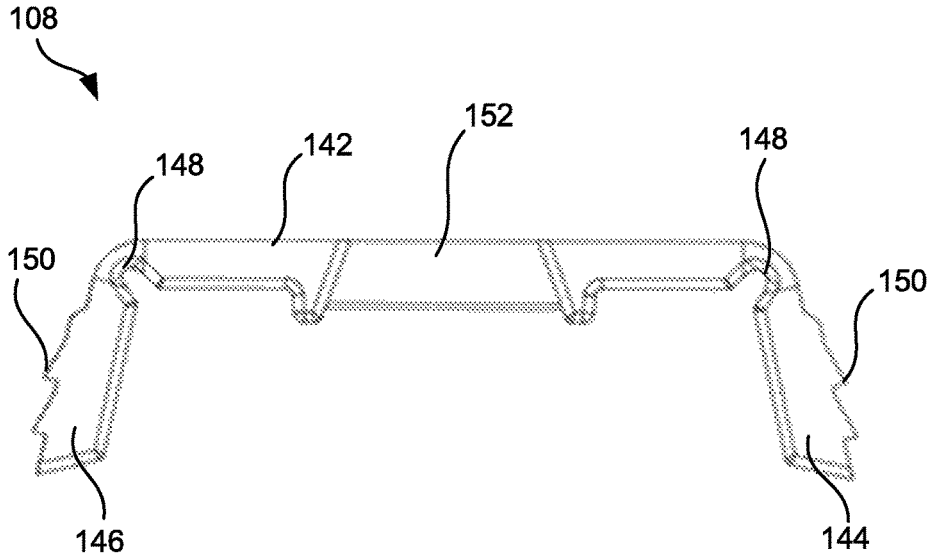
FIG. 8 is a side view of the retention component of FIG. 7.

Referring to FIGS. 1 and 2, the retention component 108 is disposed in the receiving area 126 of the housing 102 and holds the light board 106 in the housing 102. Referring to FIGS. 4-8, the retention component 108 includes a central base portion 142 and first and second retention arms 144, 146, respectively extending from opposing ends of the base portion 142. Each of the first and second retention arms 144, 146, respectively, are coupled to the base portion 142 by a flexible hinge 148. The flexible hinges 148 are disposed on opposing ends of the base portion 142 and allow the respective first and second retention arms 144, 146 to flex or rotate downwardly (as illustrated in FIG. 8) towards one another. This causes teeth 150 on each of the first and second retention arms 144, 146, respectively, to extend outward. The retention component 108 may then be disposed in the receiving area 126 of housing 102 to hold the light board 106 in the housing 102.

For example, referring to FIG. 1, as the retention component 108 is moved or placed into the receiving area 126, the flexible hinges 148 allow the respective first and second retention arms 144, 146 to flex and the respective teeth 150 to ratchet with respect to the teeth 128 on the internal surface of the receiving area 126.

Figure 4:
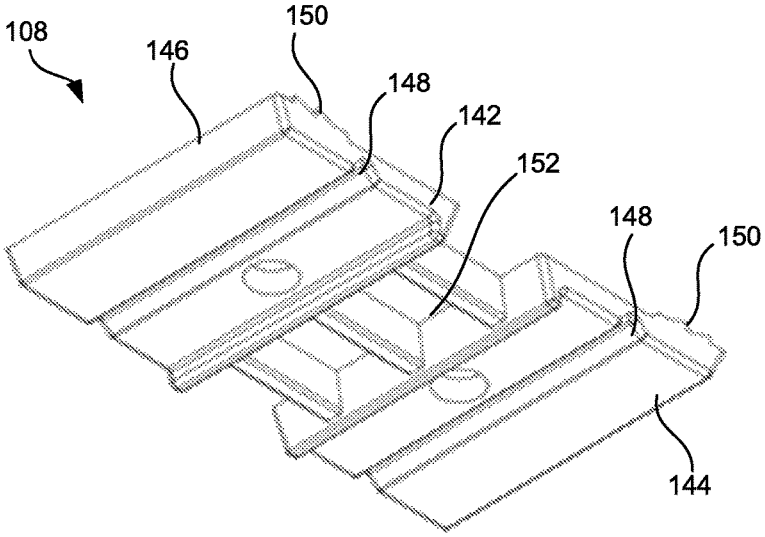
FIG. 4 is a perspective view of a retention component of the luminaire of FIG. 1, in an un-folded position.
Figure 5:
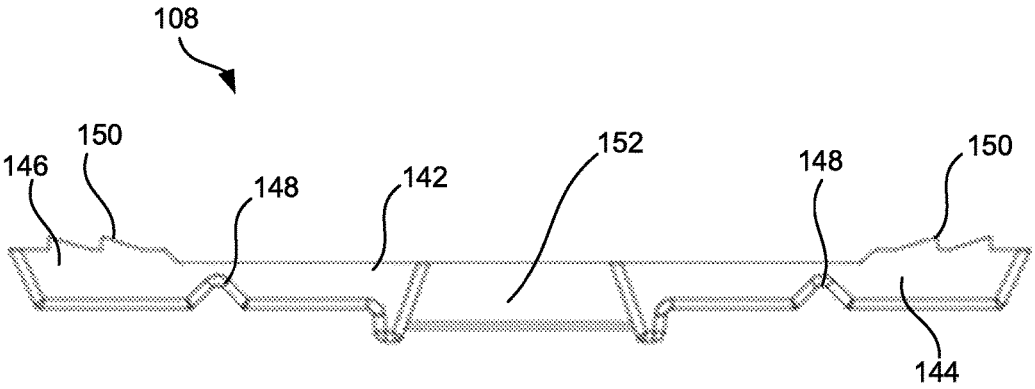
FIG. 5 is a side view of the retention component of FIG. 4.
Figure 6:
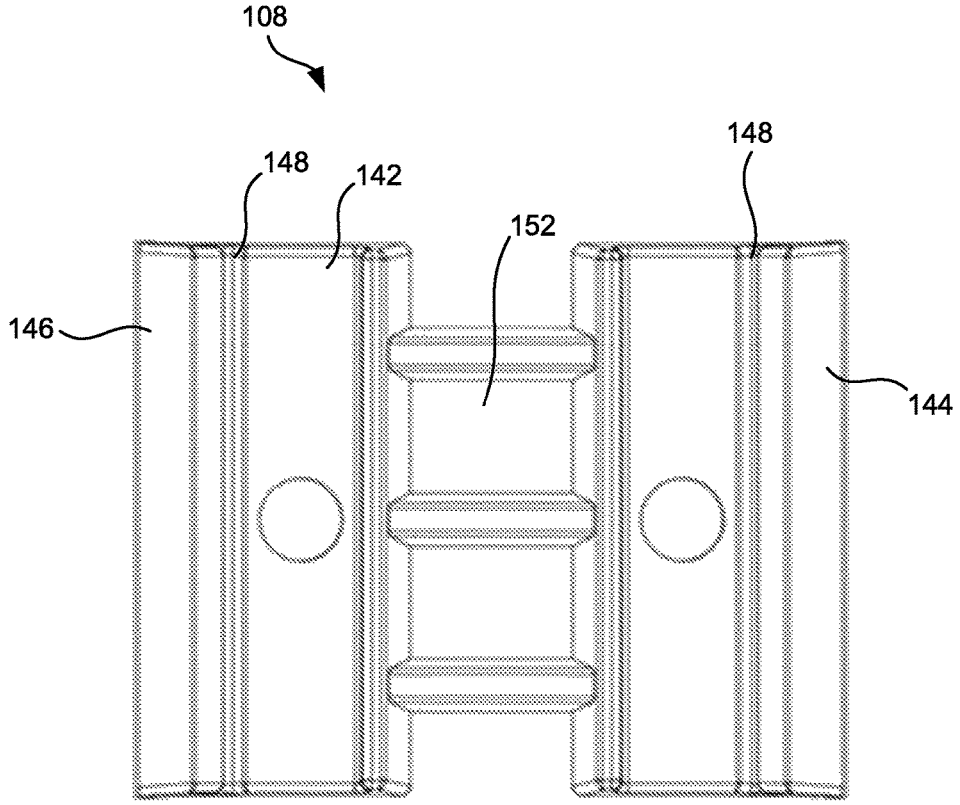
FIG. 6 is a top view of the retention component of FIG. 4.
Figure 7:
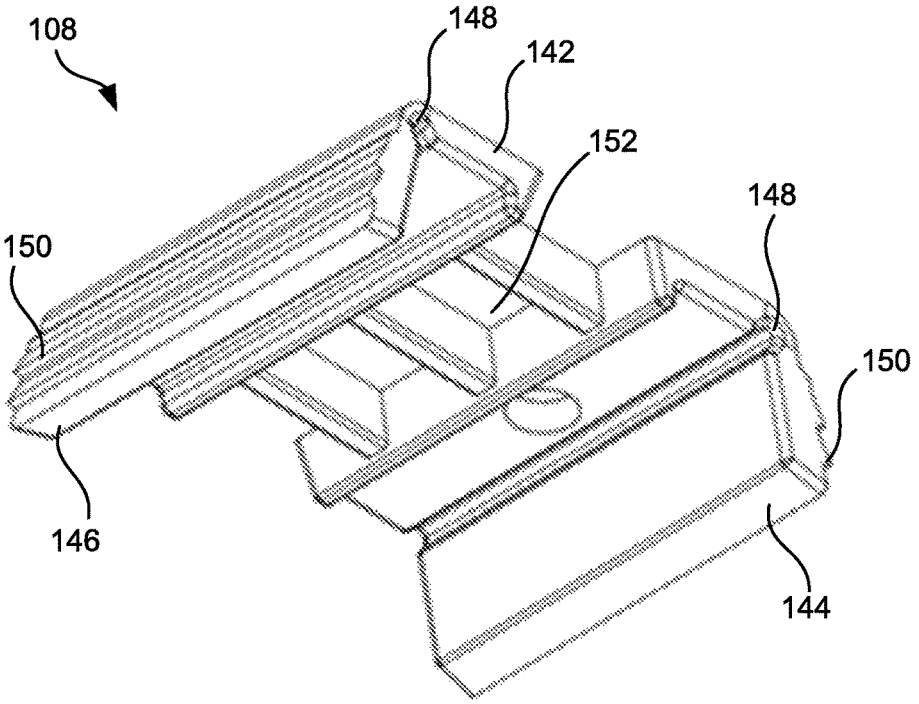
FIG. 7 is a perspective view of the retention component of FIG. 1, in a folded position.

The flexible hinges 148 may also provide a spring bias force in an outward direction that causes the respective first and second retention arms 144, 146 to be biased away from each other and disposed in alignment with a plane of the base portion 142 (as illustrated in FIGS. 4-6). This causes the teeth 150 on each of the first and second retention arms 144, 146, respectively to engage the teeth 128 on the internal surface of the receiving area 126 and hold the retention component 108 in the housing 102.

The base portion 142 also includes one or more apertures 152, each adapted to receive a lighting element 134, such as an LED. When the retention component 108 is disposed in the housing 102, each of the lighting elements 134 may be positioned in one of the apertures 152. This allows light emitted from the lighting elements 134 to be unobstructed.

The retention component 108 may also be a clear, injection molded acrylic that is non-conductive and does not cast a shadow by blocking light.

The retention component 108 is also removable from the housing 102, and allows removal of the light board 106/lighting elements 134 for service, maintenance or replacement. The retention component 108 also allows for the light board 106/lighting elements 134 to be installed in the housing 102 with reduced manufacturing time. The retention component 108 may also provide for heat transfer through a physical interconnection to the housing 102. It should be appreciated that the retention component 108 may take the place of conventional tapes and adhesives that were previously used to couple the light board 106/lighting elements 134 to the housing 102, or may be used in conjunction with such tapes and adhesives.

Figure 9:
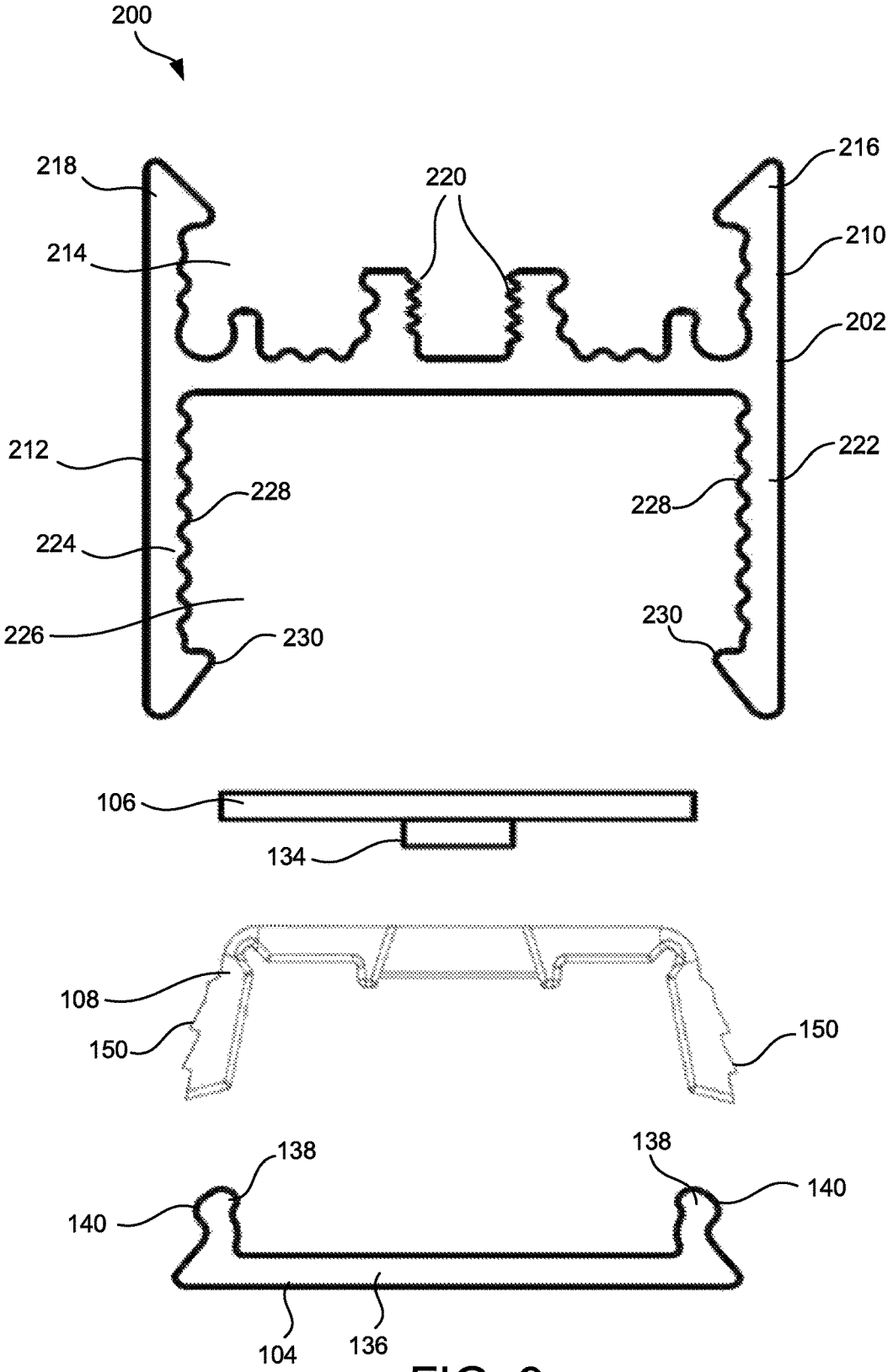
FIG. 9 is an exploded view of another luminaire according to an embodiment of the present invention.
Figure 10:
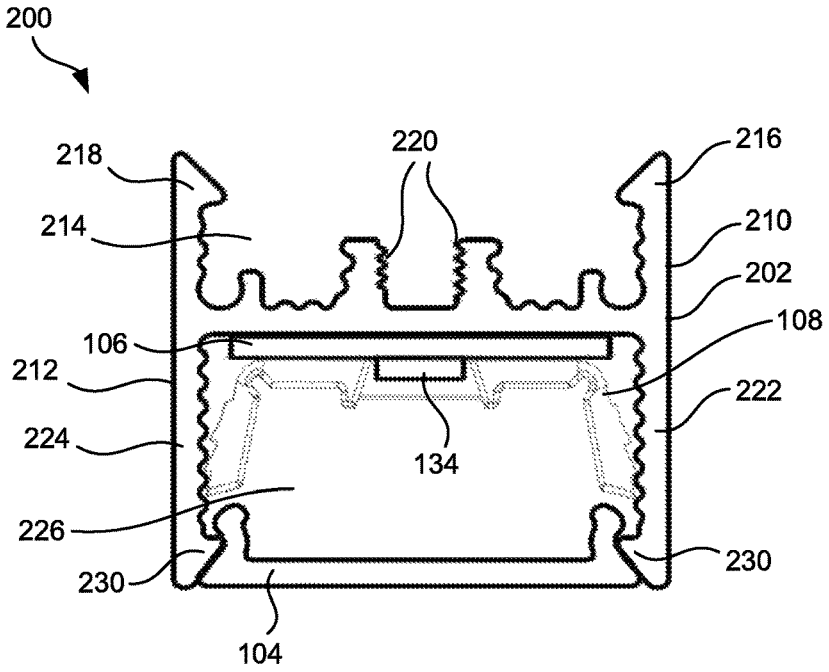
FIG. 10 is a side view of the luminaire of FIG. 9.

While the luminaire 100 is described as being adapted to couple to a T-bar type hanger for a suspended ceiling, other types of luminaires and structural supports may be used as well. For example, referring to FIGS. 9 and 10, a luminaire 200 includes a structural body 202 (also referred to as a housing 202), a diffuser 104 or lens, a light board 106 (including one or more Light Emitting Diodes (LEDs), for example), and a retention component 108. It should be appreciated that the diffuser 104, light board, and retention component 108 are the same as those described above.

The housing 202 includes an upper portion 210 and a lower portion 212. The upper portion 210 includes a channel or track 214 adapted to couple to a supporting structure for installing the luminaire 200. As illustrated, the channel or track 214 is formed by opposing first and second arms 216 and 218, respectively, which extend upwardly (away from the lower portion 212). The upper portion 210 may also include teeth or threads 220 that engage one or more supporting structures for installing the luminaire 200.

The lower portion 212 includes opposing first and second support arms 222 and 224, respectively, that extend downwardly (away from the upper portion 210) forming a receiving area 226 between the first and second support arms 222 and 224, respectively. As illustrated, the receiving area 226 has an internal surface having opposing teeth 228 and opposing protrusions 230 proximate to the teeth 228, which are used in conjunction with the retention component 108 and the diffuser 104, as described above. For example, power may be supplied to the housing 202 by means of a quick disconnect mounted to or integral to the luminaire. In another embodiment, an electrical connection to the light board 106 is provided by means of a multi-pole electrical trace bonded within the housing 202 with a mating electrical spring connection to the light board 106 where no additional soldering is required during assembly.

For example, the diffuser 104 may be coupled to the support arms 222 and 224, respectively, by engaging the protrusions 230. This allows the diffuser 104 to be snap-fit into the housing 202 and close the receiving area 226. Similarly, as the retention component 108 is moved or placed into the receiving area 226, the flexible hinges 148 allow the respective first and second retention arms 144, 146 to flex and the respective teeth 150 to ratchet with respect to the teeth 228 on the internal surface of the receiving area 226. Thus, the retention component 108 retains the light board 106 in the housing 202 in a similar manner as that described above with respect to the luminaire 100 described above.

Figure 11:
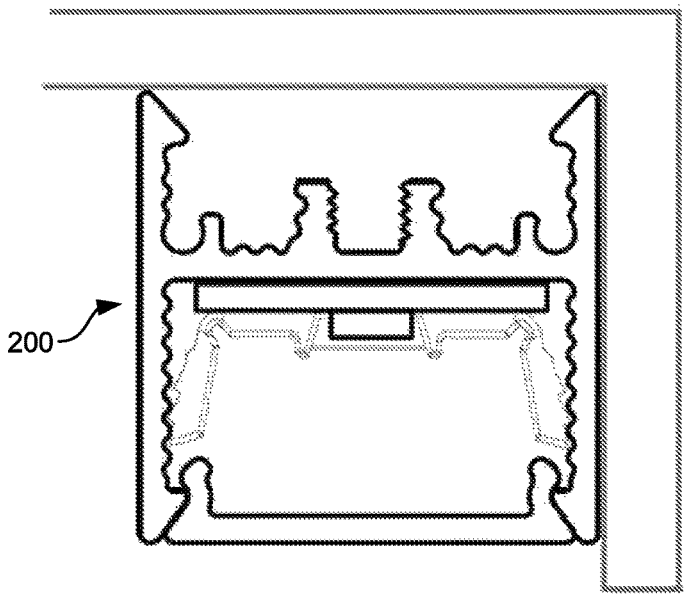
FIG. 11 is a side view of the luminaire of FIG. 10, installed in a corner.
Figure 12:
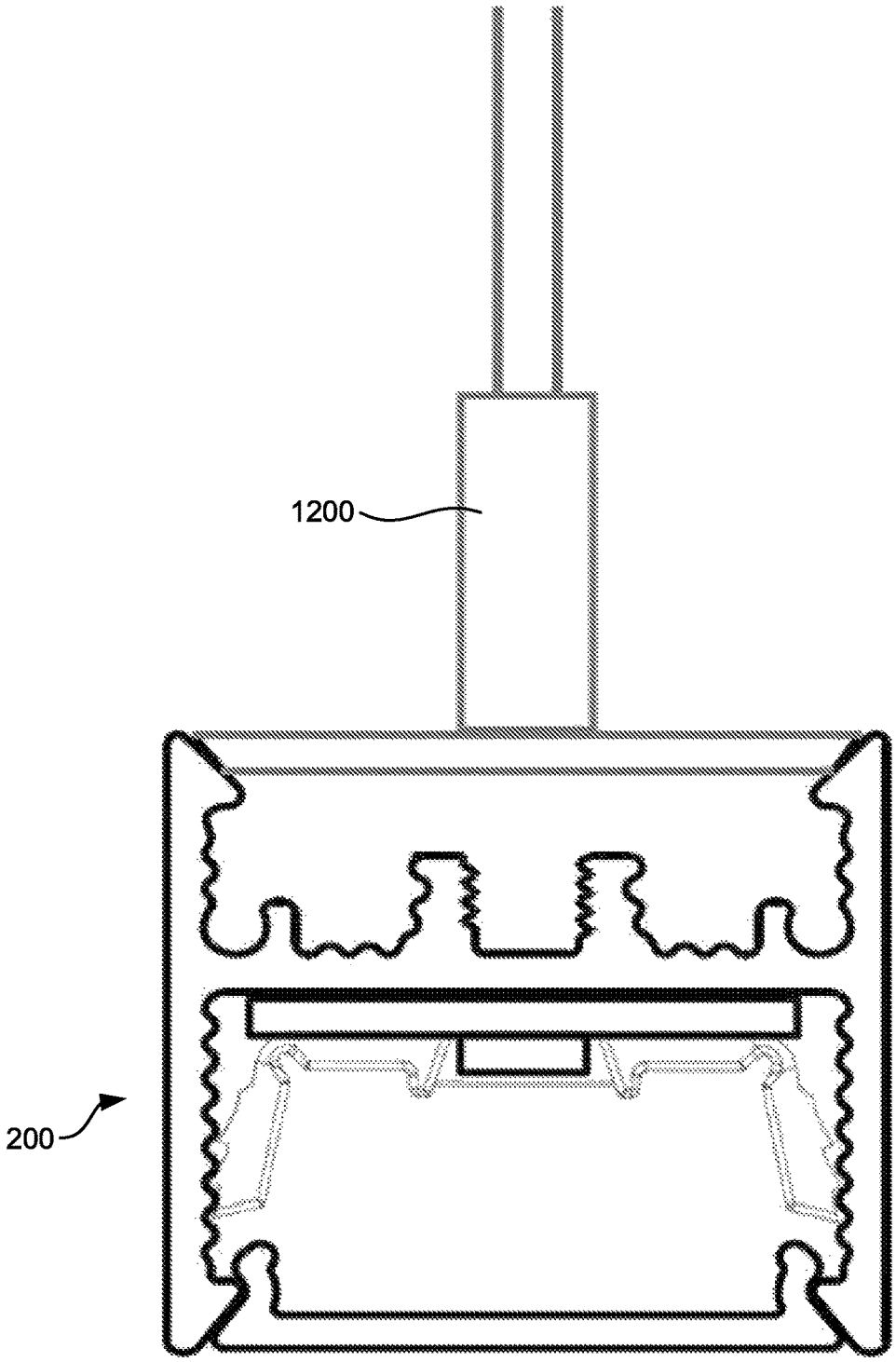
FIG. 12 is a side view of the luminaire of FIG. 10, coupled to a T-bar.

The luminaire 200 may be mounted in any number of orientations and on or recessed in any number of surfaces, such as ceilings, walls, cabinets, floors, etc. For example, the luminaire 200 may be installed horizontally, vertically, at an angle, etc. Further, the luminaire 200 may be oriented to emit light downwards, upwards, horizontally, vertically, at an angle, etc. In an example, referring to FIG. 11, the luminaire 200 may be installed in a corner area of a ceiling and wall or floor and wall. In another example, referring to FIG. 12, the luminaire 200 may be suspended from a ceiling by a "T" bar 1200 or other type of suspension structure.

Figure 13:
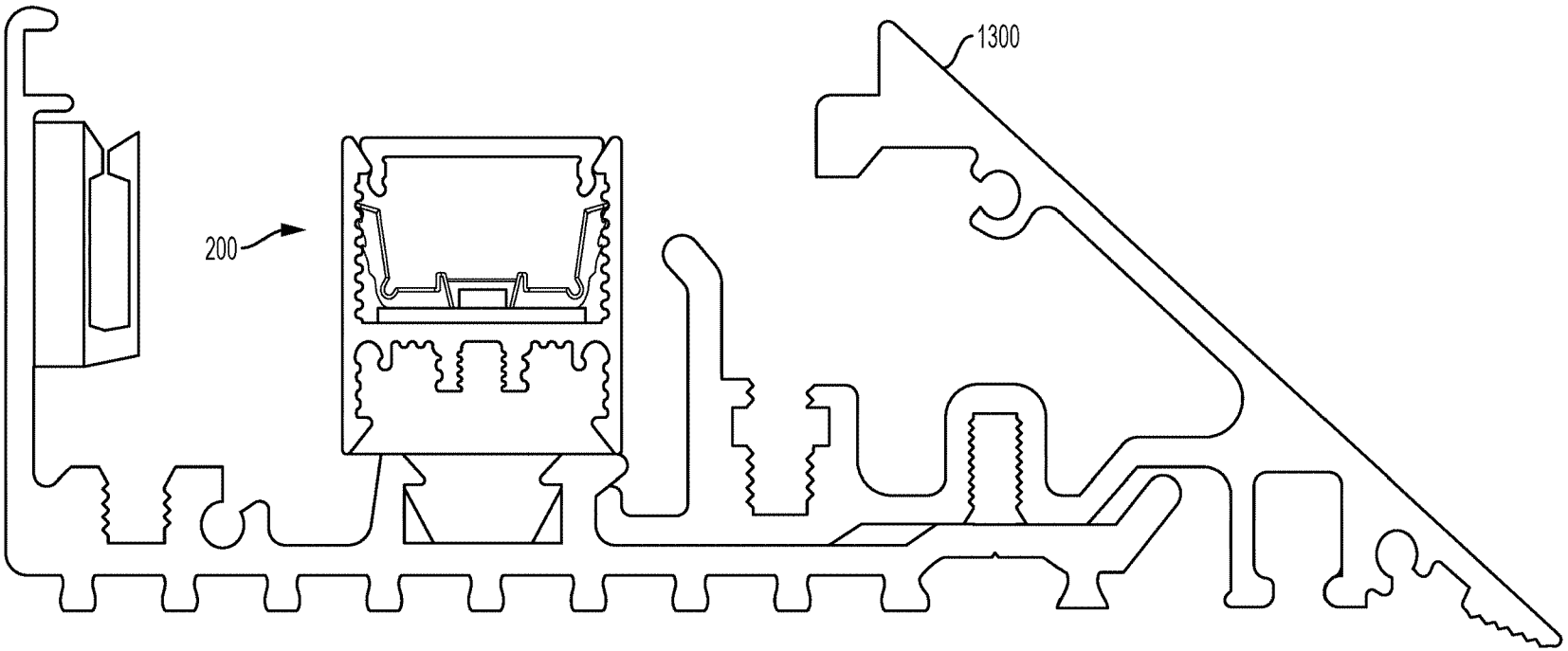
FIG. 13 is a side view of the luminaire of FIG. 10, coupled to a first mounting bracket.
Figure 14:
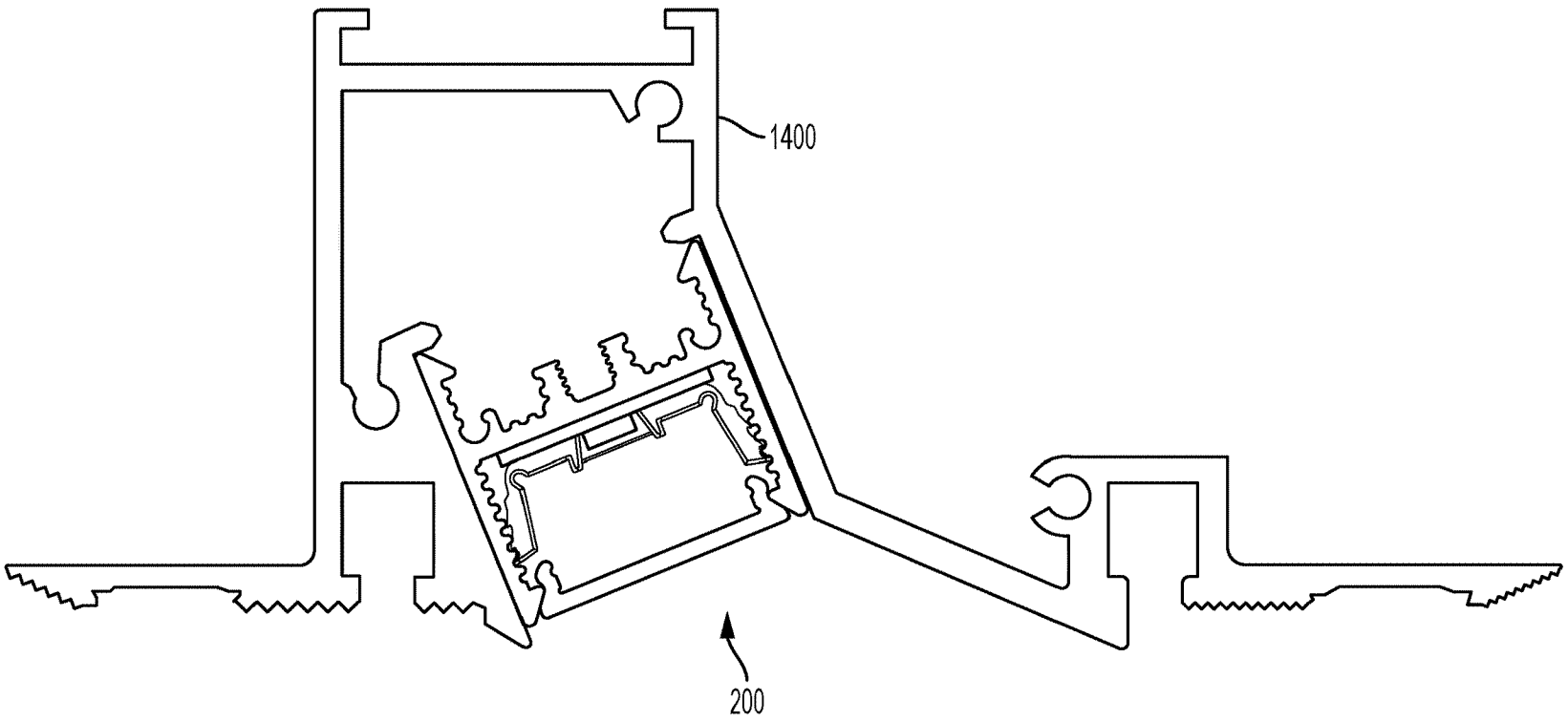
FIG. 14 is a side view of the luminaire of FIG. 10, coupled to a second mounting bracket.
Figure 15:
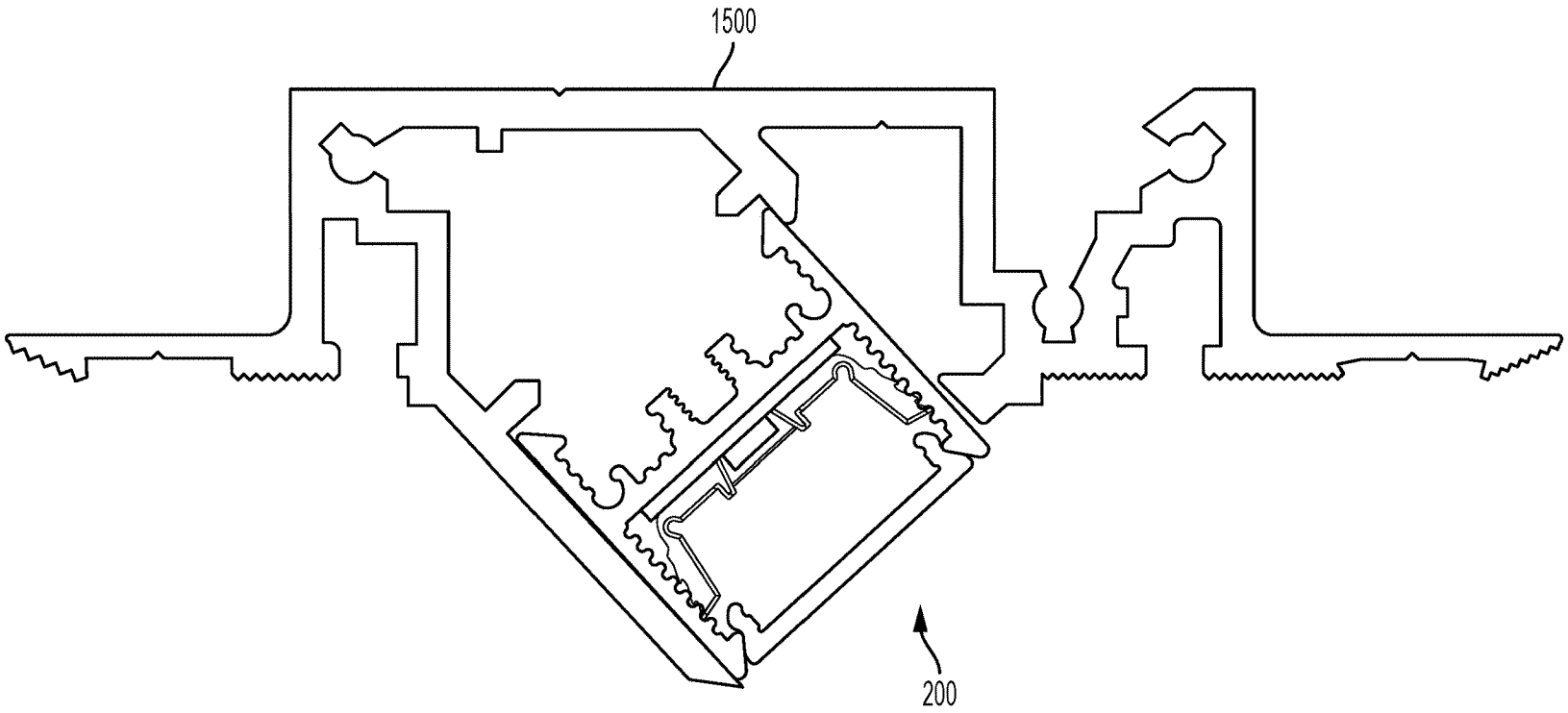
FIG. 15 is a side view of the luminaire of FIG. 10, coupled to a third mounting bracket.
Figure 16:
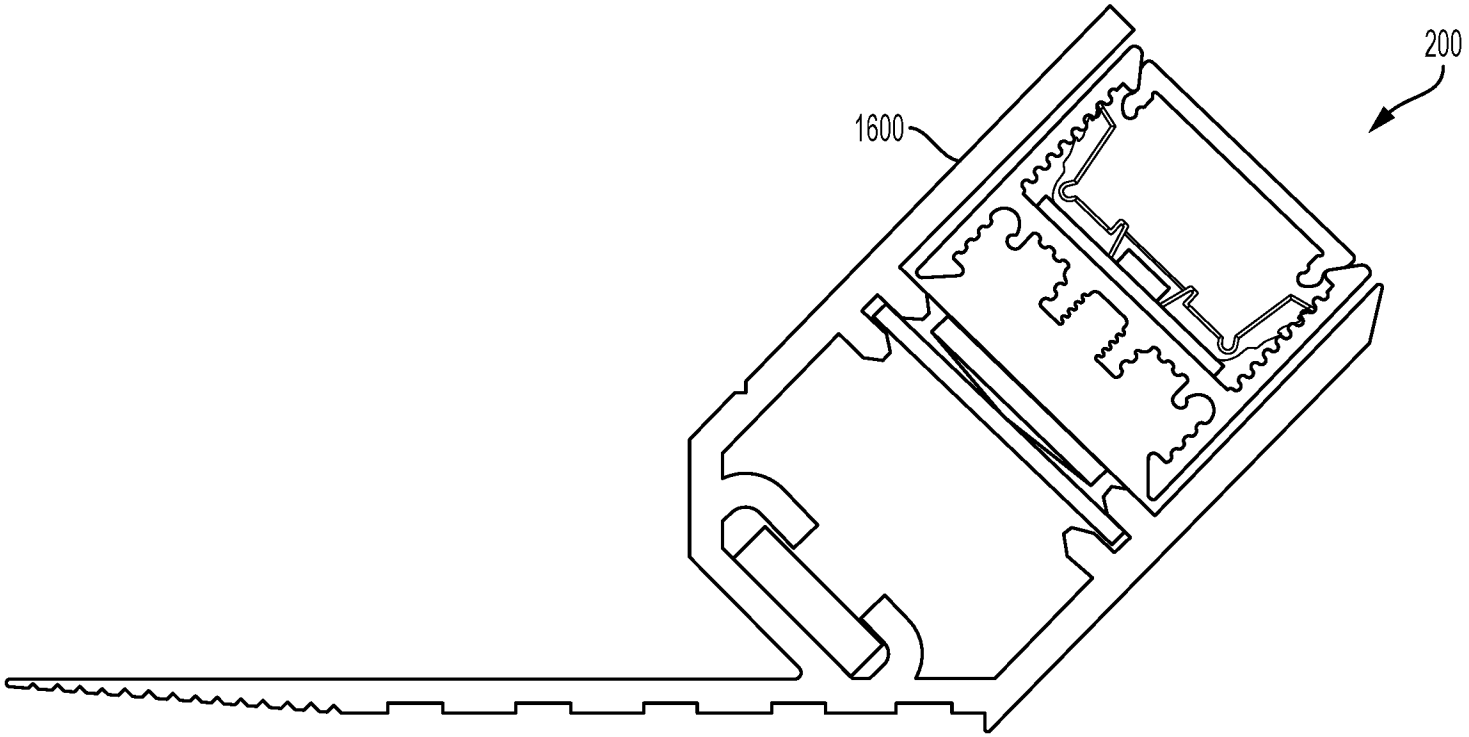
FIG. 16 is a side view of the luminaire of FIG. 10, coupled to a fourth mounting bracket.
Figure 17:
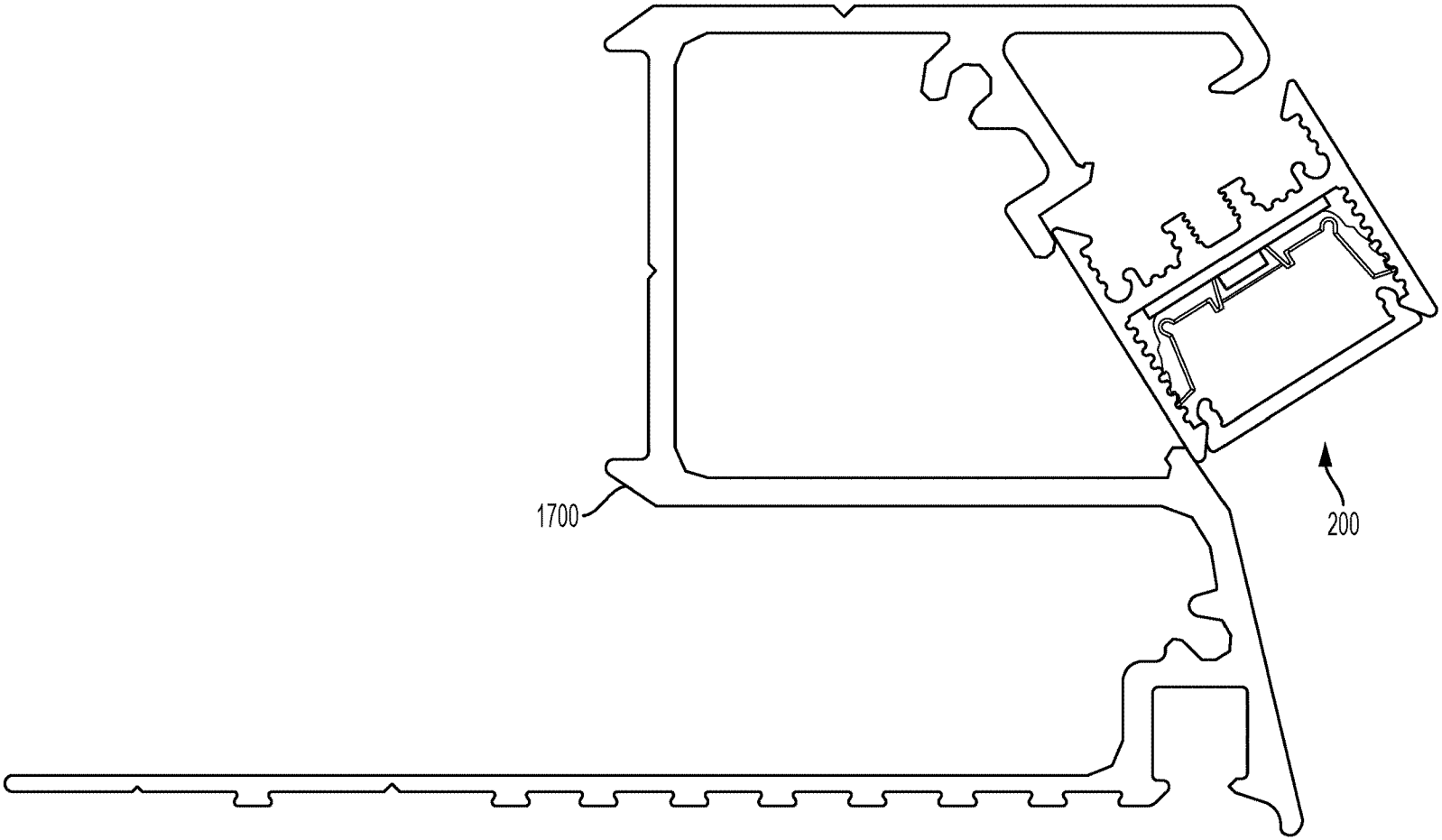
FIG. 17 is a side view of the luminaire of FIG. 10, coupled to a fifth mounting bracket.

The luminaire 200 may also be used in conjunction with other mounting structures to install the luminaire in various areas. Some examples of such structures are illustrated in FIGS. 13-17. FIG. 13 illustrates the luminaire 200 used in conjunction with a mounting structure 1300 adapted to be installed in a cove and emit light upwardly in an indirect fashion from a concealed position. FIG. 14 illustrates the luminaire 200 used in conjunction with a mounting structure 1400 adapted to be recessed in a ceiling or floor and emit light at an angle on a wall or other surface. FIG. 15 illustrates the luminaire 200 used in conjunction with another mounting structure 1500 adapted to be semi-recessed in a ceiling or floor and emit light at an angle on a wall or other surface. FIG. 16 illustrates the luminaire 200 used in conjunction with a mounting structure 1600 adapted to be installed along a perimeter of a room (such as along a ceiling or floor edge) and emit light at an angle of about 45 degrees with respect to the mounting surface. FIG. 17 illustrates the luminaire 200 used in conjunction with a mounting structure 1700 adapted to be installed in a perimeter cove and emit light down a wall from a concealed position.

Figure 18:
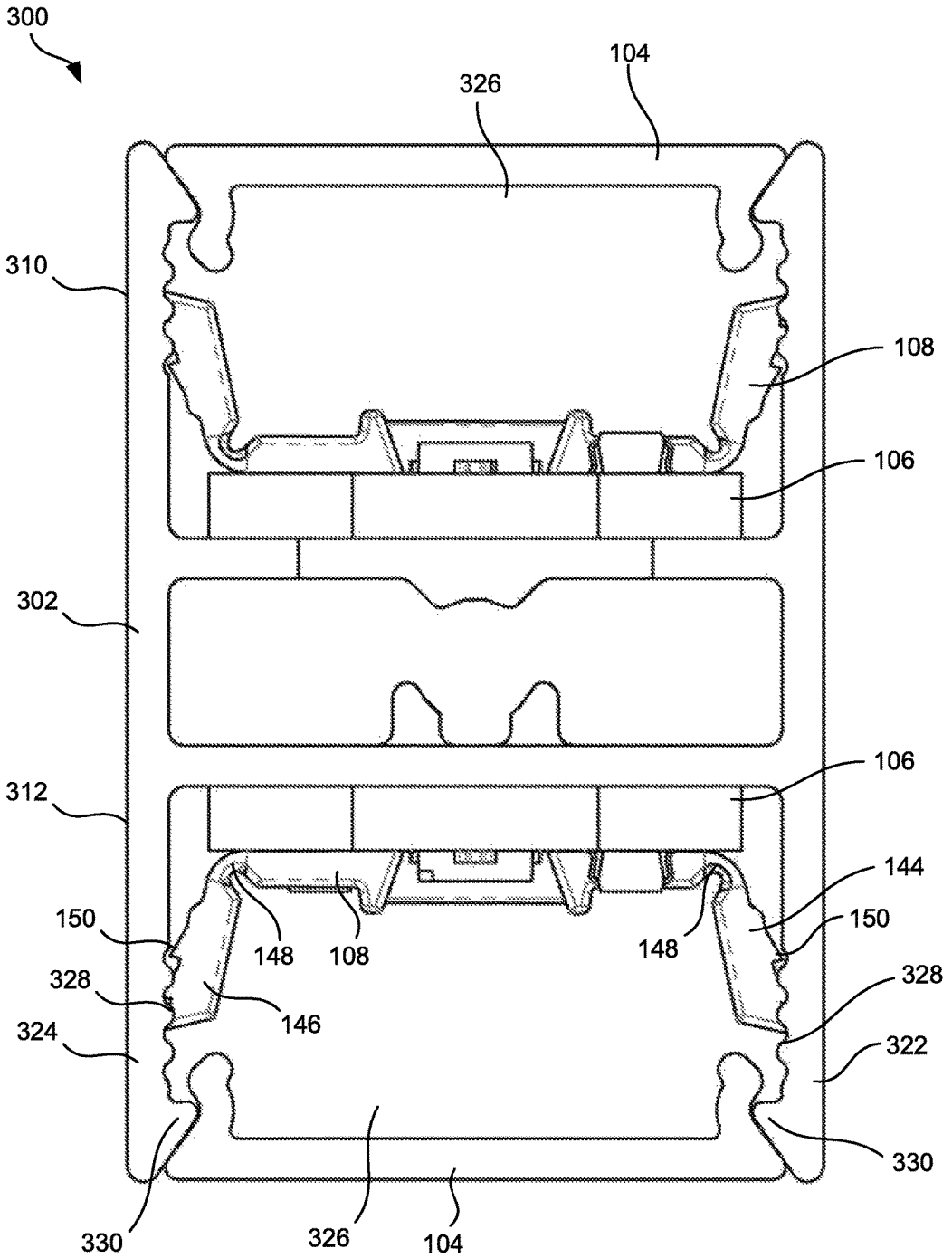
FIG. 18 is a side view of another luminaire according to an embodiment of the present invention.

The internal surface of the receiving areas 126 and 226 may also be incorporated into any other type of luminaire. For example, referring to FIG. 18, a luminaire 300 includes a structural body 302 (also referred to as a housing 302), a diffuser 104 or lens, a light board 106 (including one or more Light Emitting Diodes (LEDs), for example), and a retention component 108. It should be appreciated that the diffuser 104, light board 106, and retention component 108 are the same as those described above.

The housing 302 includes an upper portion 310 and a lower portion 312. As illustrated, the upper and lower portions 310, 312 are the same, and only the lower portion 312 will be described in detail; however, it should be appreciated that the upper portion 310 include the same features. The lower portion 312 (and upper portion 310) includes opposing first and second support arms 322 and 324, respectively, that extend downwardly (away from the upper portion 310) forming a receiving area 326 between the first and second support arms 322 and 324, respectively. As illustrated, the receiving area 326 has an internal surface having opposing teeth 328 and opposing protrusions 330 proximate to the teeth 328, which are used in conjunction with the retention component 108 and the diffuser 104, as described above. For example, power may be supplied to the housing 302 by means of a quick disconnect mounted to or integral to the luminaire 300 (for example in a channel between the upper and lower portions 310, 312). In another embodiment, an electrical connection to the light board 106 is provided by means of a multi-pole electrical trace bonded within the housing 302 with a mating electrical spring connection to the light board 106 where no additional soldering is required during assembly.

In a similar manner as described above, the diffuser 104 may be coupled to the support arms 322 and 324, respectively, by engaging the protrusions 330. This allows the diffuser 104 to be snap-fit into the housing 302 and close the receiving area 326. Similarly, as the retention component 108 is moved or placed into the receiving area 326, the flexible hinges 148 allow the respective first and second retention arms 144, 146 to flex and the respective teeth 150 to ratchet with respect to the teeth 328 on the internal surface of the receiving area 326. Thus, the retention component 108 retains the light board 106 in the housing 302 in a similar manner as that described above with respect to the luminaires 100 and 200 described above.

The luminaire 300 may be mounted in any number of orientations and on or recessed in any number of surfaces, such as ceilings, walls, cabinets, floors, etc. For example, the luminaire 300 may be installed horizontally, vertically, at an angle, etc. Further, the luminaire 300 may be oriented to emit light in two opposing directions. The luminaire 300 may also be used in conjunction with other mounting structures to install the luminaire in various areas, such as suspended from a ceiling, or other area, etc.

Figure 19:
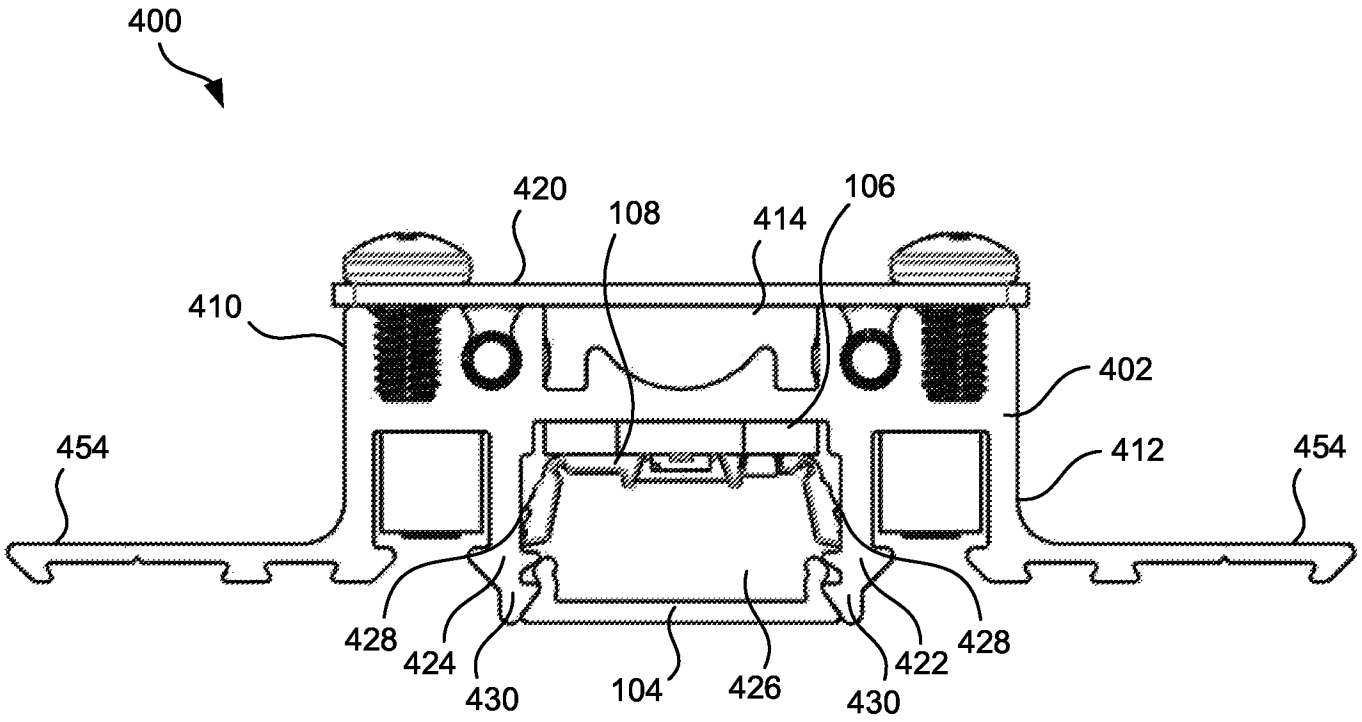
FIG. 19 is a side view of another luminaire according to an embodiment of the present invention.
Figure 20:
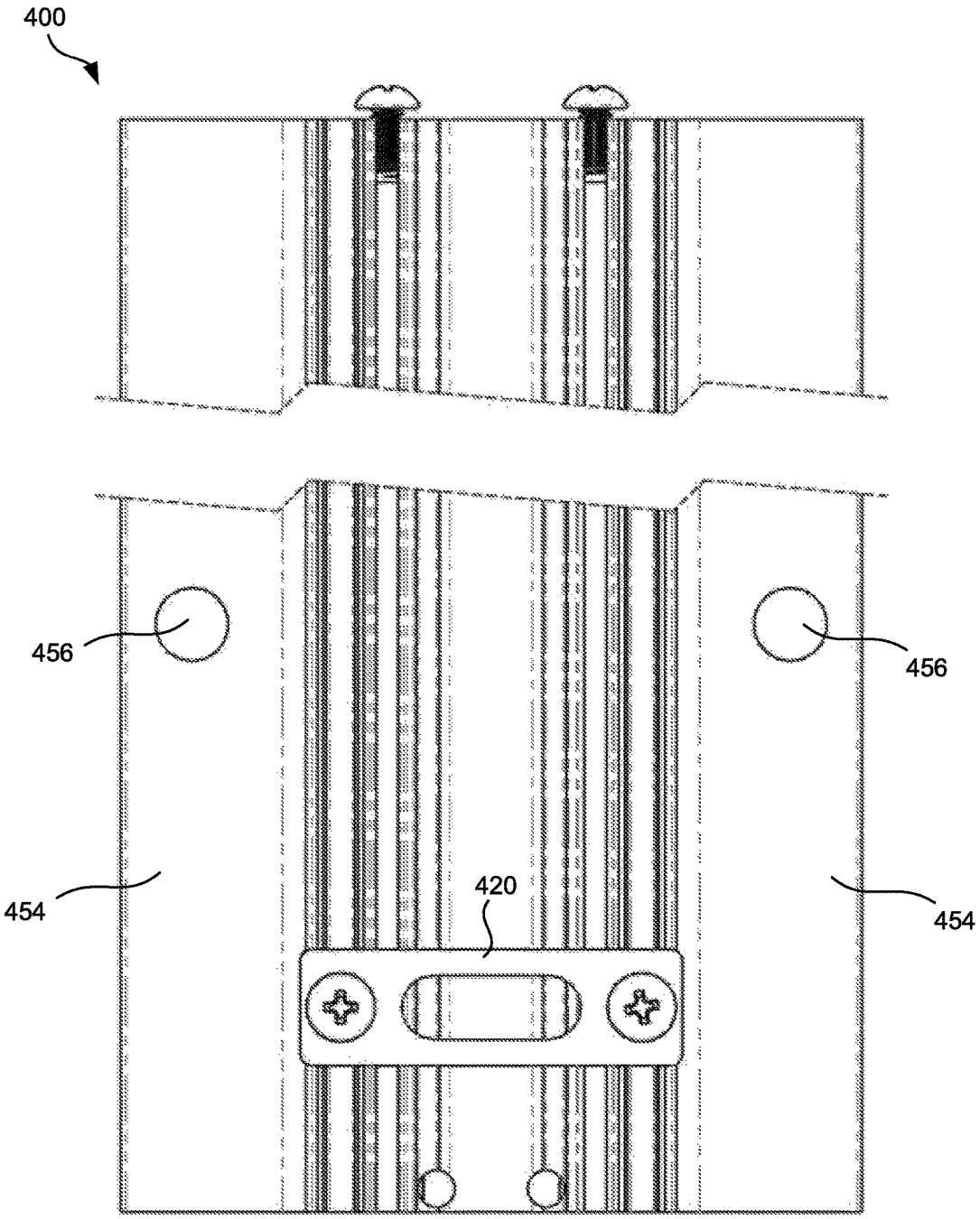
FIG. 20 is a top view of the luminaire of FIG. 19.

In another example, referring to FIGS. 19 and 20, a luminaire 400 includes a structural body 402 (also referred to as a housing 402), a diffuser 104 or lens, a light board 106 (including one or more Light Emitting Diodes (LEDs), for example), and a retention component 108. It should be appreciated that the diffuser 104, light board 106, and retention component 108 are the same as those described above.

The housing 402 includes an upper portion 410 and a lower portion 412. The upper portion 410 includes a channel or track 414 adapted to house one or more wiring connections. The upper portion 210 may also include bracket 420 and fasteners that may be used to engage one or more supporting structures for installing the luminaire 400. The lower portion 412 includes opposing first and second support arms 422 and 424, respectively, that extend downwardly (away from the upper portion 410) forming a receiving area 426 between the first and second support arms 422 and 424, respectively. As illustrated, the receiving area 426 has an internal surface (similar to the internal surfaces of receiving areas 126, 226, and 326) having opposing teeth 428 and opposing protrusions 430 proximate to the teeth 428, which are used in conjunction with the retention component 108 and the diffuser 104, as described above. Power may be supplied to the housing 402 by means of a quick disconnect mounted to or integral to the luminaire 400 (for example in channel 414). In another embodiment, an electrical connection to the light board 106 is provided by means of a multi-pole electrical trace bonded within the housing 402 with a mating electrical spring connection to the light board 106 where no additional soldering is required during assembly.

In a similar manner as described above, the diffuser 104 may be coupled to the support arms 422 and 424, respectively, by engaging the protrusions 430. This allows the diffuser 104 to be snap-fit into the housing 402 and close the receiving area 426. Similarly, as the retention component 108 is moved or placed into the receiving area 426, the flexible hinges 148 (illustrated in FIG. 8) allow the respective first and second retention arms 144, 146 to flex and the respective teeth 150 (illustrated in FIG. 8) to ratchet with respect to the teeth 428 on the internal surface of the receiving area 426. Thus, the retention component 108 retains the light board 106 in the housing 402 in a similar manner as that described above with respect to the luminaires 100-300 described above.

The luminaire 400 may be mounted in any number of orientations and on or recessed in any number of surfaces, such as ceilings, walls, cabinets, floors, etc. For example, the luminaire 400 may be installed horizontally, vertically, at an angle, etc. Further, the luminaire 400 may be oriented to emit light downwards, upwards, horizontally, vertically, at an angle, etc. The luminaire 400 may also be used in conjunction with other mounting structures to install the luminaire in various areas, such as suspended from a ceiling, or other area, etc.

As illustrated in FIGS. 19 and 20, the luminaire 400 may be adapted to be mounted in a surface. For example, the luminaire 400 may include outwardly extending mounting arms 454 extending in opposing directions away from the receiving area 426. Fastener apertures 456 may be disposed in or extend through the respective mounting arms 454, to allow the mounting arms 454 to be coupled to a surface. In one example, the luminaire 400 may be recessed in the surface and project light outwardly away from the surface.

While a number of different luminaires are described herein, any type of luminaire may include the receiving area with internal surface that is adapted to receive the retention component 108 and/or diffuser 104. It should also be appreciated that the luminaires 100-400 may be linear in shape and customizable in length and width suitable for a particular application. Further, the luminaires 100-400 may be coupled to a mounting surface or recessed in a mounting surface. Similarly, the mounting structures 1300-1700 may be coupled to a mounting surface or recessed in a mounting surface, as desired to provide the desired amount and direction of light emission.

As used herein, the terms "coupled," "coupling," and its functional equivalents are not intended to necessarily be limited to a direct, mechanical coupling of two or more components. Instead, the term "coupled" and its functional equivalents are intended to mean any direct or indirect mechanical, electrical, or chemical connection between two or more objects, features, work pieces, and/or environmental matter. "Coupled" is also intended to mean, in some examples, one object being integral with another object.

The matter set forth in the foregoing description and accompanying drawings is offered by way of illustration only and not as a limitation. While particular embodiments have been shown and/or described, it will be apparent to those skilled in the art that changes and modifications may be made without departing from the broader aspects of the invention. The actual scope of the protection sought is intended to be defined in the following claims when viewed in their proper perspective.

What is claimed is:

1. A luminaire, comprising:

a housing having a receiving area with an internal surface;

first and second opposing teeth disposed on the internal surface and extending towards each other into the receiving area;

a light board disposed in the receiving area; and a retention component disposed in the receiving area and holding the light board in the receiving area, the retention component has opposing first and second retention arms with respective ratcheting teeth adapted to engage the first and second opposing teeth to hold the light board in the housing.

2. The luminaire of claim 1, further comprising opposing first and second protrusions disposed on the internal surface and extending towards each other into the receiving area.

3. The luminaire of claim 2, further comprising a diffuser adapted to engage the first and second protrusions and couple to the housing.

4. The luminaire of claim 1, wherein the retention component includes a base portion and the first and second retention arms are respectively coupled to opposing ends of the base portion by first and second flexible hinges.

5. The luminaire of claim 4, wherein the first and second flexible hinges provide a spring bias force that biases the first and second retention arms away from each other.

6. The luminaire of claim 1, wherein the light board includes a light emitting diode and the retention component includes an aperture that receives the light emitting diode.

7. The luminaire of claim 1, wherein the housing includes a channel adapted to couple to a T-bar type hanger for a suspended ceiling.

8. The luminaire of claim 1, wherein the housing includes a lower portion forming the receiving area, and an upper portion extending from the lower portion.

9. The luminaire of claim 8, wherein the upper portion includes opposing first and second arms extending away from the lower portion and inwardly towards one another to form a channel having an inverted "T" shape.

10. The luminaire of claim 8, wherein the lower portion includes opposing first and second support extending away from the upper portion and forming the receiving area.

11. The luminaire of claim 10, wherein each of the respective first and second support arms are adapted to receive and support a ceiling tile.

12. A retention component adapted to retain a light board in a luminaire housing, comprising:

a base portion having opposing first and second ends;

first and second hinges respectively coupled to the opposing first and second ends;

first and second retention arms respectively coupled to the first and second hinges; and first and second teeth respectively disposed on the first and second retention arms, wherein the first and second teeth are adapted to engage the luminaire housing and retain the light board in the luminaire housing.

13. The retention component of claim 12, wherein the first and second hinges provide a spring bias force that biases the first and second retention arms away from each other.

14. The retention component of claim 12, wherein the base portion includes an aperture that receives a light emitting diode of the light board.

15. The retention component of claim 12, wherein the retention component is made of a clear, injection molded acrylic.

16. The retention component of claim 12, wherein the retention component is adapted to transfer heat generated by the light board to the luminaire housing when the retention component is installed in the luminaire housing.

17. A luminaire having a light emitting element, comprising:

a housing having a receiving area with an internal surface;

first and second opposing teeth disposed on the internal surface and extending towards each other into the receiving area; and a retention component disposed in the receiving area, the retention component including:

a base portion having opposing first and second ends;

first and second hinges respectively coupled to the opposing first and second ends;

first and second retention arms respectively coupled to the first and second hinges; and first and second ratchet teeth respectively disposed on the first and second retention arms, wherein the first and second ratchet teeth are respectively adapted to engage the first and second opposing teeth and retain the light emitting element in the luminaire.

18. The luminaire of claim 17, wherein the base portion includes an aperture adapted to allow light to be emitted from the light emitting element.

19. The luminaire of claim 17, further comprising opposing first and second protrusions disposed on the internal surface and extending towards each other into the receiving area.

20. The luminaire of claim 19, further comprising a diffuser adapted to engage the first and second protrusions and couple to the housing.

* * * * *